United States Patent [19]

Takahashi et al.

[11] 4,030,447

[45] June 21, 1977

[54] DEVELOPING DEVICE

[75] Inventors: Toru Takahashi, Tokyo; Kimio Nakahata, Kawasaki; Hidejiro Kadowaki, Yokohama, all of Japan

[73] Assignee: Canon Kabushiki Kaisha, Tokyo, Japan

[22] Filed: Oct. 7, 1975

[21] Appl. No.: 620,402

[30] Foreign Application Priority Data

Oct. 10, 1974 Japan ..... 49-116899

[52] U.S. Cl. ..... 118/658; 355/3 DD

[51] Int. Cl.[2] ..... G03G 15/09

[58] Field of Search ..... 118/637, 653, 656, 657, 118/658; 355/3 DD; 427/18

[56] References Cited

UNITED STATES PATENTS

| | | | |
|---|---|---|---|
| 3,828,730 | 8/1974 | Yamashita et al. | 118/637 |
| 3,900,001 | 8/1975 | Fraser et al. | 118/637 |
| 3,939,801 | 2/1976 | Tanaka et al. | 118/637 |

*Primary Examiner*—Henry S. Jaudon

[57] ABSTRACT

This specification discloses a device for developing electrostatic latent images by the use of developer. The device includes a photosensitive medium bearing electrostatic latent images on the surface thereof to be developed, a container for containing therein magnetic carrier and toner, a permanent magnet fixedly mounted within the container, and a non-magnetic sleeve enclosing the magnet and rotatably mounted in the container for transporting the developer from the container to the latent image bearing surface. The permanent magnet has poles of identical polarity disposed adjacent to each other at positions opposed to the latent image bearing surface. Thus, development can be effected in the developing station by utilization of repelling magnetic fields produced by the poles of identical polarity.

13 Claims, 17 Drawing Figures

DEVELOPING DEVICE

BACKGROUND OF THE INVENTION

1. Field of the Invention

This invention relates to a developing device generally applicable in electrophotographic copying machines, and more particularly to improvements in or relating to the magnetic brush developing device.

2. Description of the Prior Art

Among the developing devices heretofore applied in electrophotographic copying machines, there are known those which utilize the powder cloud method, the cascade method, the magnetic brush method or the like, and they have their own unique features and are pratically used in various fields in accordance with those features.

Among these, the powder cloud method and the cascade method are meritorious for the copying of business documents inasmuch as these have the edge effect so called because the developing toner concentrates upon surface portions of a photosensitive medium where the inclination of the electric field of an electrostatic latent image thereon is great, namely, the surface portions of the photosensitive medium which correspond to the portions of an original image in which the image density is discontinuous, and such portions appear emphasized in the resultant reproduced image. However, this same merit will present itself as a demerit in the reproduction of ordinary tone images, namely, the reproduction of the portions of an original image in which the image density is continuously varied. Further, any of the power cloud method and the cascade method is disadvantageous in that the developing devices therefor become larger in volume because of the requirement that the developing area must be wider.

In contrast, the magnetic brush method is such that a developer consisting of a mixture of iron powder and developing toner is attracted to a magnet so that the developer is formed into a brush-like shape at the portions of the magnet where the poles thereof exist, and the electrostatic latent image on the photosensitive medium is caused to make frictional contact with the brush-shaped developer to thereby accomplish development and reproduction of the image. In this case, the iron powder itself acts as a soft developing electrode and can therefore cause the developing toner to be deposited in proportion to the charge density of the electrostatic latent image and thus, this method is suitable for the reproduction of tone images. Also, the developing device for carrying out this method can be made compact.

As an improvement over such magnetic brush developing device, there is known a system which comprises a magnet rod disposed with the poles thereof arranged circumferentially of the rod so that adjacent ones of the successive poles are opposite in polarity, and a non-magnetic member provided around the magnet rod and in which the two members are moved relative to each other to thereby form magnetic brushes on the surface portions of the non-magnetic member corresponding to the magnetic poles so that these magnetic brushes make soft frictional contact with the surface to be developed, thereby accomplishing development. For example, refer to the following patents:

U.S. Pat. Nos. 3,040,704; 3,145,122; 3,152,924; 3,176,652; 3,455,276; 3,543,720; 3,608,522; 3,724,422; etc.

Such magnetic brush developing device according to the prior art has involved a difficult problem in the reproducibility of the density of original image. The reason is that once the toner, which is deposited on a copying medium, usually a sheet of paper, has covered the copying medium in the form of one or two layers, the density of the copy image is no longer varied but assumes saturated condition even if the number of the toner layers is increased. Because of this, the copy image will be very hard in visual impression as compared with the original image. In order to soften the impression of such copy image in an effort to approximate it to that of the original image, the quantity of toner deposited must generally be decreased, whereas this has in turn resulted in reduced reproducibility of character images.

Also, in the device of this type, an effort to utilize the repelling magnetic fields of the magnetic means has often encountered difficulties in transporting the magnetic developing material from the developing container to the developing station and there is known no method which perfectly utilizes the repelling magnetic fields as well as the coaction thereof with the centrifugal force, gravity, inertia force, etc. of the developing material.

SUMMARY OF THE INVENTION

It is an object of the present invention to provide a developing device which eliminates all the above-noted disadvantages peculiar to the various developing methods of the prior art and have as many merits as possible.

It is another object of the present invention to provide a developing device in which a non-magnetic member and a magnet are arranged in the named order with respect to a surface to be developed, the magnet being disposed so that those of the poles thereof opposed to the surface to be developed are identical in polarity and adjacent to each other, and in which the surface to be developed, the non-magnetic member and the magnet are moved relative to one another to thereby cause the developer to fly up to the surface to be developed between the poles of identical polarity, thus accomplishing development.

It is still another object of the present invention to provide a developing device in which said poles of identical polarity are located at such positions as to induce a combined effect of gravity of the developer and repelling magnetic field formed by the identical poles arranged in the developing station so that the repelling magnetic fields may be positively utilized.

It is yet still another object of the present invention to provide a developing device in which a fixed magnet rod and a non-magentic member rotatable about the rod are provided to enable utilization of the repelling magnetic fields and poles of identical polarity are located in the developing station opposed to the surface to be developed and in a predetermined spaced apart relationship on the circumference of the magnet rod, the locations of said poles being downward as viewed in the direction of rotation of the non-magnetic rotatable member.

Other objects and features of the present invention will become fully apparent from the following detailed description of the invention taken in conjunction with the accompanying drawings.

DESCRIPTION OF THE PREFERRED EMBODIMENTS

Figure 1A:
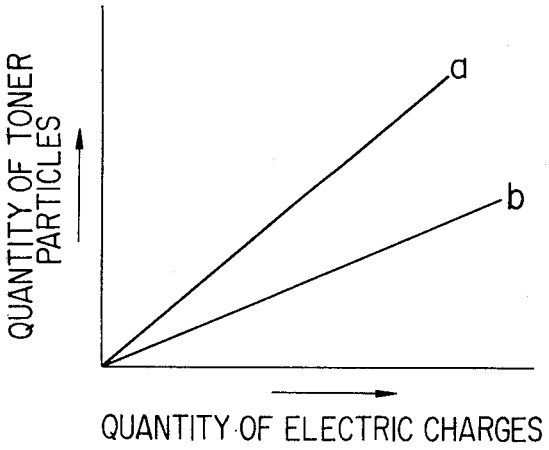
FIG. 1A is a graph illustrating the relation between quantity of electric charges and quantity of deposited toner.
Figure 1B:
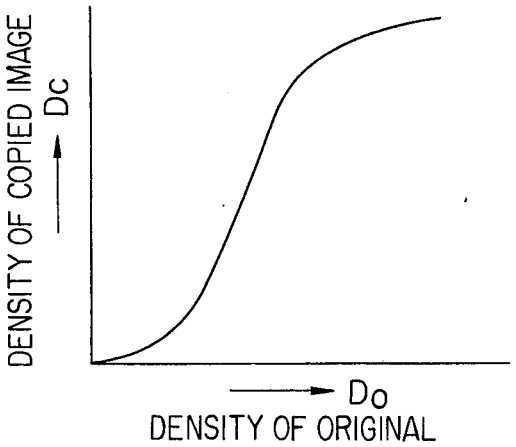
FIG. 1B is a graph illustrating the relation between density of original image and density of copy image.

Reference will first be had to FIGS. 1A and B to describe the relation between the original image and the copy image during the image reproduction effected by the magnetic brush developing device according to the prior art. The relation between the quantity of charges of the electrostatic latent image on a surface to be developed and the quantity of developing toner deposited thereon according to the prior art method is such as indicated by line *a* in FIG. 1A. That is, the quantity of charges and the quantity of toner deposited are in proportional relationship with each other, and when such relation is represented in terms of the original image density $D_O$-copy image density $D_C$ characteristic of the copy image as shown in FIG. 1B, it will be seen that $D_C$ assumes saturated condition at a predetermined value of the original image density $D_O$. Therefore, the tone image can no longer be identified in the area of the image which has the predetermined or greater density. This shows that once the toner has been deposited in one or two layers over the copying medium, the copy image density $D_C$ is never varied even if the toner layers are further increased, and such a copy image will give a visual impression as a very hard tone image. In order to soften such impression of the image, the quantity of toner deposited must have such a characteristic as indicated by line *b* in FIG. 1A, whereas this will involve a disadvantage that the reproducibility of the character image is reduced.

Figure 2:
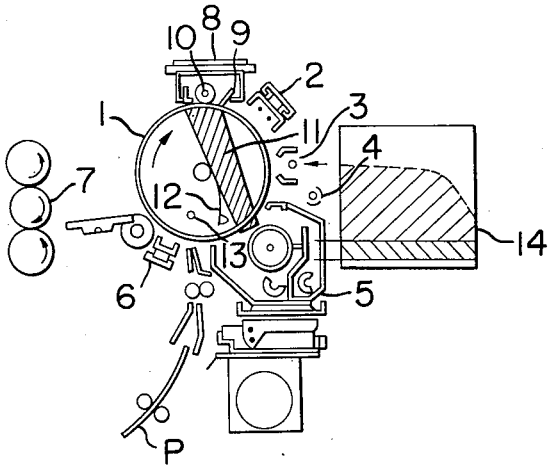
FIG. 2 is a front view showing essential portions of an electrophotographic copying machine to which the developing device of the present invention is applied.

FIG. 2 schematically illustrates an example of the inventive developing device which eliminates the above-noted disadvantages, as it is applied to an electrophotographic copying machine of the image transfer type. In FIG. 2, reference numeral 1 designates a drum-shaped photosensitive medium for electrophotography comprising an insulating layer, a photoconductive layer and a conductive back-up layer. The surface of the photosensitive medium is uniformly charged to any desired polarity by a primary corona discharger 2, and then subjected to simultaneous application of DC corona discharge opposite in polarity to the primary charge or AC corona discharge and image light, by means 3 for simultaneous application of secondary corona discharge and image light. Next, if required, the surface of the photosensitive medium may be subjected to allover exposure by allover exposure means 4 to thereby form thereon an electrostatic latent image with high contrast. The electrostatic latent image is then developed into a visible image by a developing device 5 of the present invention, and the visible image is transferred to a transfer medium P under the effect of the transfer field provided by a transfer corona charger 6. The transfer medium P is then separated from the photosensitive drum, whereafter it is heated for fixation of the transferred image by a fixing roller 7.

After the image transfer untransferred toner particles on the photosensitive drum are scraped off therefrom by a cleaning blade 9 in a cleaner device 8, whereafter the scraped toner particles are conveyed toward an axial end of the photosensitive drum by a conveyor screw 10 and passed through a toner recovering duct 11 provided in contact with that end of the drum and recovered in the developing device 5 for reuse. To prevent bridging of the toner in the recovering duct 11, a duct beating member (resilient material) 12 is mounted within the duct and a driver pin 13 for the beating member is secured to said end of the photosensitive drum, so that the untransferred toner may be positively recovered into the developing device through the vibrating action provided by the driver pin and the beating member.

The developer has magnetic carrier particles such as iron powder and triboelectrically charged toner particles.

Disposed within the developing device is toner concentration detector means for detecting the concentration of toner in the developer, which detector means utilizes the well-known carrier-toner breakdown voltage variation detecting method to measure the developing capacity of the developer. By the detection signal from the concentration detector means, replenishment developer is supplied from a hopper 14 at suitable times. The replenishment developer contains therein 40–50% by weight of carrier, and the carrier in the developing device increased by the supply of the replenishment developer overflows from the developing device for discharge. In such method, the fresh carrier in the replenishment developer and the old carrier in the developing device are always in mixed condition so that image reproduction can continue in a stable condition for a long time. Further, the developing device now under discussion is equipped with novel toner scatter preventing means which eliminates the need to provide a suction blower and a toner filter which were indispensably necessary for the recovery of scattered toner particles in the conventional dry type copying machine, and this in turn enables dry type copying apparatus to be designed.

A specific construction of the developing device according to the present invention will now be described in detail.

Figure 3B:
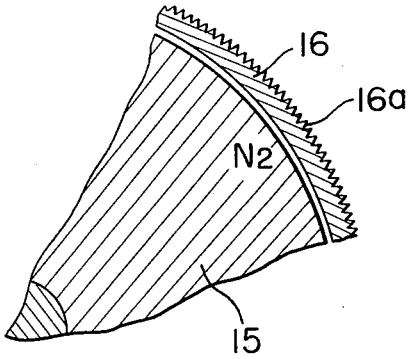
FIG. 3B is an enlarged view of a portion of FIG. 3 A.
Figure 3A:
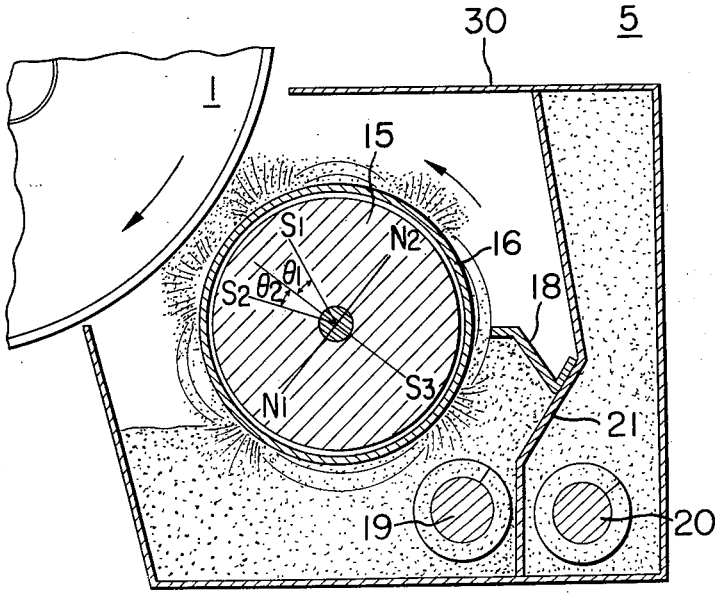
FIG. 3A is a cross-sectional view of an embodiment of the developing device according to the present invention.

FIG. 3A shows, in cross-section, an embodiment of the developing device according to the present invention.

Within a developing container 30, there is mounted a fixed magnetic roller 15 and a rotatable sleeve 16 of nonmagnetic material surrounds the magnetic roller 15 and is supported for rotation thereabout. The pole arrangement of the magnetic roller 15 will first be considered. The shown magnetic roller 15 is of five-pole construction which includes a developer conveying pole $N_1$, developer pumping poles $S_3$ and $N_2$ for pumping up the developer from the supply station, and developing poles $S_1$ and $S_2$ opposed to the surface to be developed and directly taking part in development. The developing poles $S_1$ and $S_2$, identical in polarity, are angularly spaced apart by angles $\theta_1$ and $\theta_2$, respectively, with respect to the line passing through the pole $S_3$ and the center of the magnetic roller 15, and the angles $\theta_1$ and $\theta_2$ may be in the relation that $\theta_1 = \theta_2$.

A doctor blade 18 is fixed within the developing container to control the rising thickness of the developer (containing carrier and toner) on the sleeve pumped up to the developing station by the pumping poles $S_3$ and $N_2$ so as to assume a predetermined value, say, 2 to 3 mm. The location and configuration of the doctor blade and the intensity of the magnetic flux at the control position of the doctor blade determine the stable control of the developer around the sleeve and the magnitude of the driving torque of the sleeve. In the present device, the control of the developer is effected in the vicinity of the pumping poles by the use of the knife-edged doctor blade 18 and the surface of the sleeve is knurled as indicated by **16*a* in FIG. 3B**, thereby limiting the intensity of the magnetic flux at the control position and realizing stable conveyance and pump-up of the developer, and this has enabled the advent of a low driving torque developing device necessary to high-speed copying machines.

Figure 4A:
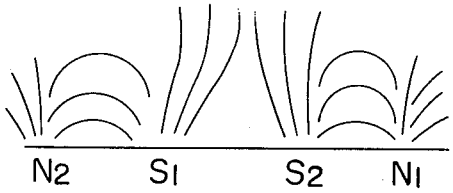
FIG. 4A and B are developed views illustrating the distribution of magnetic fields and magnetic forces produced by a magnet rod in the device shown in FIG. 3A.
Figure 4B:
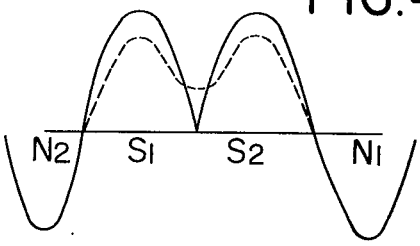

Disposed behind the developer pumping poles $S_3$ and $N_2$ are developing poles $S_1$ and $S_2$ and these two adjacent poles of identical polarity produce repelling magnetic fields. These repelling fields, with the magnetic fields produced by the adjacent poles $N_1$ and $N_2$, are shown in FIG. 4A. The magnetic force of the repelling fields, with that of the fields produced by the other poles, are shown in FIG. 4B. As will be seen in FIG. 4B, the intensity of the magnetic force is substantially zero nearly at the mid-point between the poles $S_1$ and $S_2$ (see solid line). Of course, if the magnetic force at the mid-point between the two poles $S_1$ and $S_2$ is reduced to the vicinity of zero in the manner as indicated by the broken line, there will be provided the effect of repelling fields which will hereinafter be described, and zero magnetic force is not always compulsory. In other words, it is required that the magnetic brushes formed by the poles $S_1$ and $S_2$ of identical polarity make contact with the photosensitive medium while a space is formed between the two brushes. Also, these developing poles of identical polarity, if located in the area of downward movement of the sleeve 16 as viewed in its direction of rotation, will be effective to produce a preferable cooperative relationship between the quantity and centrifugal force of the developer and the repelling fields, and the developing poles are shown to be at such position.

Figure 5:
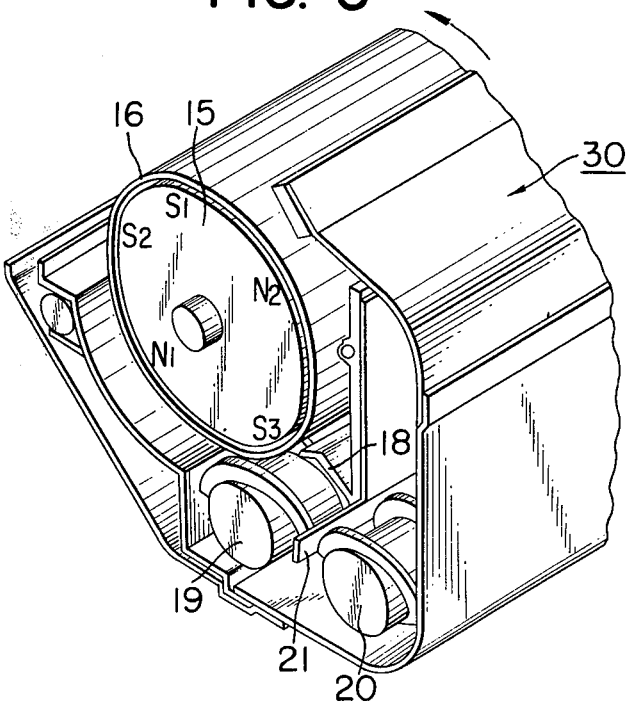
FIG. 5 is a perspective view of the device shown in FIGS. 3A and B.

Reference numerals 19 and 20 in FIG. 3A and FIG. 5 designate a pair of screws for conveying the developer axially of the sleeve and stirring the developer which are disposed with a developer partition plate 21 interposed therebetween. The developer is conveyed to the back by the screw 20, as viewed in the figures, and at the back end position, the developer is delivered to the screw 19 through a reversely rotating screw provided at the back end of the screw 20 and through a developer passage hole formed in the back end portion of the partition plate 21, and thence the developer is conveyed forwardly by the screw 19. When the shown arrangement of the conveyor screws 19 and 29 is employed, the developer may be distributed highly uniformly in the axial direction of the sleeve by selecting the conveyance capacities of the screws 19 and 20 at a ratio of 6:0 to 8:10.

FIG. 5 is a perspective view corresponding to FIG. 3A, but the developer is omitted there to clearly show the construction of the magnetic roller.

Operation of the developing device shown in these figures will now be explained.

After the developer has been supplied into the developing container 30, the non-magnetic sleeve 16 is rotated in the direction of arrow from the position shown in FIG. 3A. The photosensitive medium 1 is then rotating in the direction of arrow. With the rotation of the sleeve, the developer is pumped up and conveyed along the outer surface of the sleeve by the cooperation between the developer pumping poles $S_3$ and $N_2$ and reaches the position of one of the developing poles, $S_1$. At the position of the pole $S_1$, there is the repelling magnetic field as shown in FIG. 4A and thus, due to the action of such repelling field and of the centrifugal force resulting from the rotation of the sleeve, the developer is repelled in a direction perpendicular to the surface of the sleeve 16 and strikes against the surface of the photosensitive drum 1 to thereby develop the electrostatic latent image carried on that surface.

This development, just as in the case of the cascade development method, involves the phenomenon of the developer moving over the surface of the photosensitive medium.

Since the photosensitive drum 1 has already been moved in the direction of arrow in FIG. 3A, the developer which has struck against the surface of the photosensitive medium is attracted back to the surface of the non-magnetic sleeve as the pole $S_2$ approaches, and again on the non-magnetic material, the movement of the developer takes place to form a magnetic brush.

In the course of movement of the developer from the pole $S_1$ to the pole $S_2$, the mutual attraction between carrier particles is weakened because, in the intermediate area between the two poles, the intensity of the magnetic force between the non-magnetic sleeve and the photosensitive medium is in the vicinity of zero and as the result, a powder cloud phase is induced by the centrifugal force of the rotating sleeve and the coaction between the repelling fields of the two poles $S_1$ and $S_2$. The surface to be developed is softly developed by the developer in such phase, whereby image reproduction with harmony can be accomplished with fidelity. Also, at the opposite ends of the powder cloud, the magnetic brushes rise into frictional contact with the surface to be developed, so that the developer in the powder cloud phase cannot be scattered outwardly to contaminate the ambient air. Further, during the powder cloud phase, even if the iron powder as carrier is at all deposited on the surface to be developed, such iron powder will again be separated from that surface and forced back to the surface of the sleeve by the magnetic brush which is then rising therebelow (the position of $S_2$).

Thus, in the developing station, the development is effected both in a manner like the cascade development by the magnetic brushes on the developing poles of identical polarity and in a manner like the powder cloud development in the area between the two magnetic brushes, as a result of which there may be provided a copy image density faithful to the original image density.

After the development, the magnetic brushes lie down in the intermediate area between the poles $S_2$ and $N_1$ to restore the supply position, whereafter the developer is subjected to a stirring effect by being conveyed from the pole $N_1$ to the subsequent pole $S_3$ and further shifted to the developer pumping step in preparation for reuse.

Thus, by the utilization of the repelling fields produced by the two magnetic poles of identical polarity juxtaposed in the developing station and also by the utilization of the relative movement of the non-magnetic sleeve and the photosensitive medium, there is obtained image development highly excellent in character reproducibility or tone image reproducibility which enjoys not only the merit of the conventional magnetic brush method but also the combined merit of the above-described cascade-like development and powder-cloud-like development. In the foregoing description, the non-magnetic sleeve and the photosensitive drum have been shown as being moved in the direction which proved to be the best directions as the result of an experiment, whereas the movement directions and the speed ratio of the sleeve and the drum are relatively arbitrary and other movement relations may also lead to a good result depending on the conditions under which the developing device is used.

Further, the magnetic poles of identical polarity disposed in the developing station are not restricted to the S-poles but N-poles may equally be used.

Figure 6A:
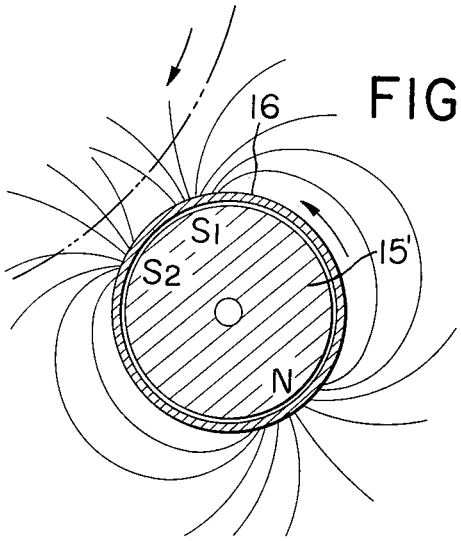
FIG. 6A is a front view of another embodiment of the present invention and showing the construction of a magnet rod with three poles and a non-magnetic rotatable member, particularly for illustrating the principle of the invention.
Figure 6B:
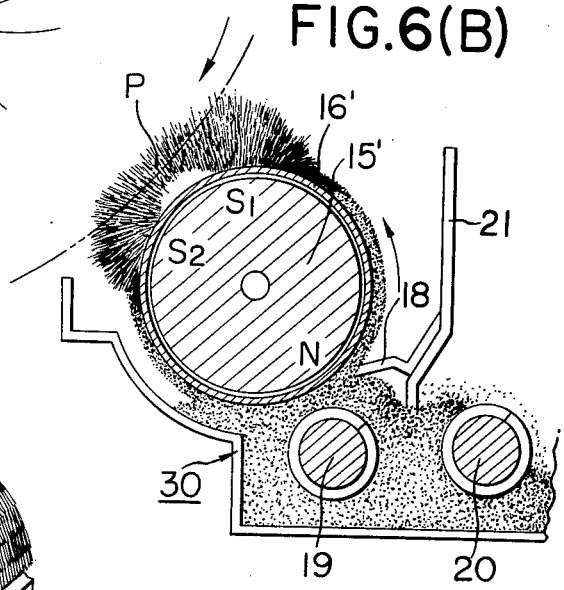
FIG. 6B is a front view showing the manner in which magnetic brushes are formed in the developing device of FIG. 6A.
Figure 7:
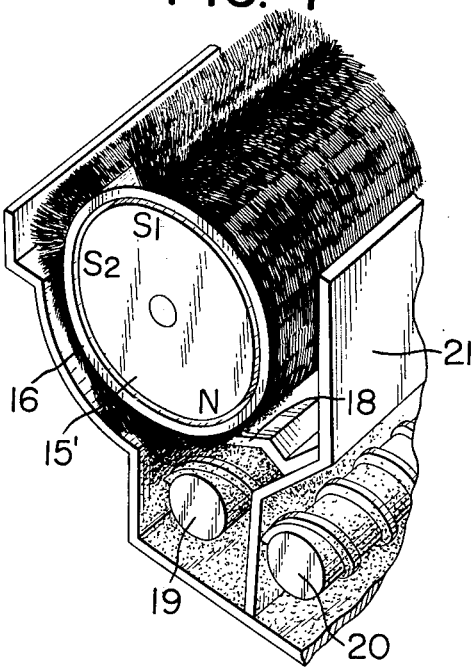
FIGS. 7 and 8 are perspective views of the FIG. 6B developing device as seen from right and above and from left and above, respectively.
Figure 8:
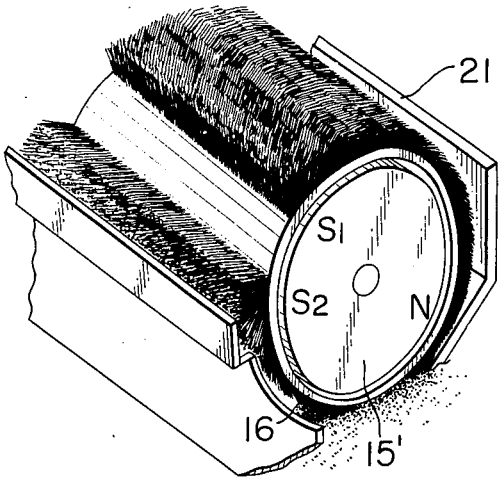

Reference will now be had to FIGS. 6 to 8 to describe a three-pole magnetic roller. This pole arrangement is simpler in principle and easier to understand. Those elements common to FIGS. 3A and 5 are given similar reference characters.

FIG. 6A shows an arrangement which comprises poles $S_1$ and $S_2$ of identical polarity disposed in the developing station in a predetermined spaced apart relationship with each other, a fixed magnetic roller 15' having a different pole N in the developer supply station, and a non-magnetic sleeve 16 surrounding and rotatable around the magnetic roller 15'. The flow lines schematically show the magnetic lines of force between the poles N-$S_1$ and N-$S_2$ and the magnetic lines of force of the repelling fields produced by the poles $S_1$ and $S_2$.

FIG. 6B is a cross-sectional view of the developing device having the magnetic roller 15' and the rotatable sleeve 16 shown in FIG. 6A, and the position of the surface to be developed is particularly indicated by a dots-and-dash line to clearly show how the magetic brushes are formed on the surface of the sleeve.

FIGS. 7 and 8 are perspective views of the FIG. 6B device as seen from different angles, and clearly show the manner in which the magnetic brushes are rising. As will particularly be seen from these figures, the use of the magnetic roller 15' having two identical poles (shown as S-poles) disposed in spaced apart relationship in the developing station results substantially in the absence of the magnetic brushes on the surface of the sleeve between the two poles with the aid of the repelling fields. These figures show the result of the empirical observation.

FIGS. 7 and 8 show the sleeve 16 in its stationary condition and it will be seen that the no-brush zone between the poles $S_1$ and $S_2$ under such condition is covered with the developer P in powder cloud phase, in FIG. 6B which shows the sleeve 16 in its rotative condition. Actual development is therefore carried out by such powder cloud phase developer and the magnetic brushes at the opposite ends thereof, the latter effecting the cascade-like development. Thus, as in the case of the previously described five-pole arrangement, the surface to be developed may undergo a development which is rich in harmony and suited for the reproduction of lineal original images.

Figure 9:
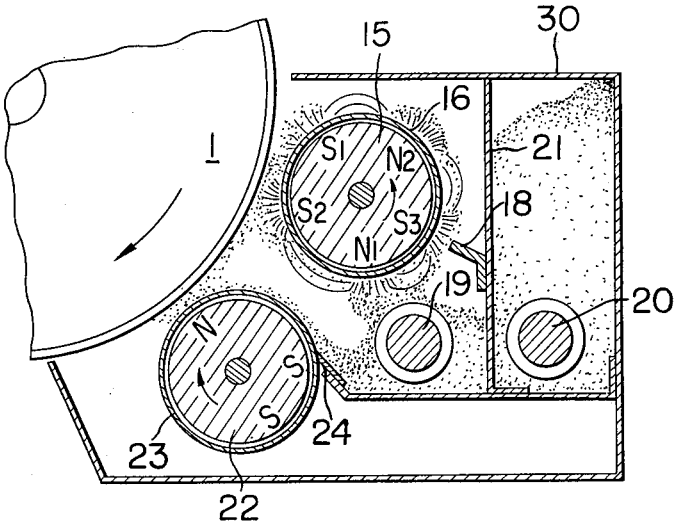
FIG. 9 is a front sectional view of another embodiment of the developing device according to the present invention.

FIG. 9 shows another embodiment of the developing device according to the present invention. Reference characters similar to those in FIG. 3A are similar in significance to them. In FIG. 9, there is disposed, below the developing magnetic brush rotatable member shown in FIG. 3A, a developer stirring rotatable member comprising a fixed magnetic rod 22, a non-magnetic cylinder 23 surrounding and rotatable around the magnetic rod 22 in the direction of arrow and a doctor blade 24 frictionally slidable with respect to the outer periphery of the non-magnetic cylinder 23. The pole arrangement of the fixed magnetic rod is similar to that shown in FIG. 3A, that is, development is effected by the developing magnetic brush rotatable member, and that part of the developer (containing more or less carrier) deposited on the surface of the photosensitive medium and that part of the developer riding on the surface of the developing magnetic brush rotatable member after development are attracted by the magnetic force of a developer recovering rotatable member and onto the non-magnetic cylinder. Thereafter, those parts of the developer are removed by the blade 24 frictionally sliding with respect to the surface of the non-magnetic cylinder for reuse in development. The use of such developer recovering rotatable member enables removal of excess developing toner and unnecessary carrier deposited on the surfaces of the photosensitive medium, which in turn leads to great and many advantages such as prevention of fogging of the background area of the copy image, protection of the photosensitive drum surface against the injury imparted by the carrier, economy of the developer, etc.

Figure 10A:
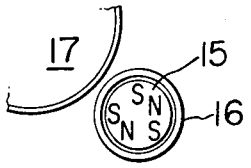
FIGS. 10A – C schematically illustrate some other examples of the pole arrangement different from that of the magnet rod in the developing device shown in FIG. 3A.
Figure 10B:
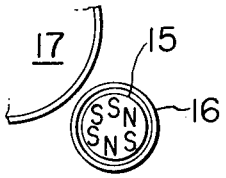
Figure 10C:
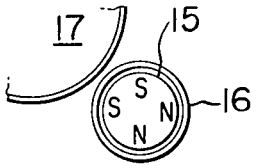

FIGS. 10A, B and C show various pole arrangements in the fixed magnetic rod of the developing magnetic brush rotatable member, whereas any other pole arrangement will be applicable in which the phenomena explained in connection with the FIG. 2 embodiment are utilized in the developing station for the photosensitive medium.

Figure 11:
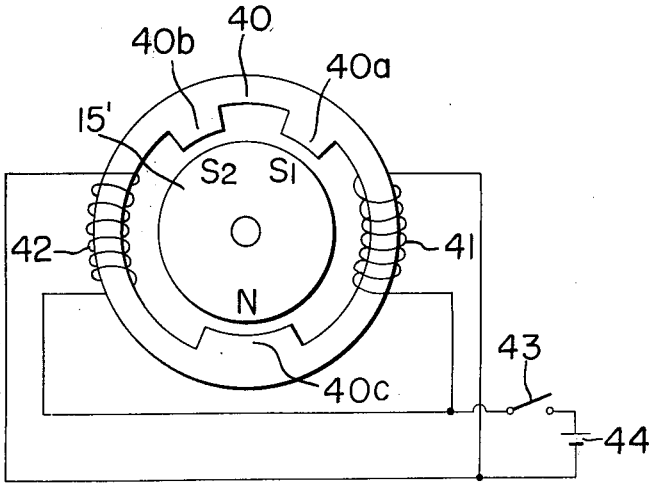
FIG. 11 illustrates the method whereby the three-pole magnetic roller shown in FIGS. 6–8 magnetized.

FIG. 11 shows the mode of magnetization of the three-pole magnetic roller 15' illustrated in FIGS. 6 to 8. In FIG. 11, an electromagnetic soft iron member 40 having salient poles 40*a*, 40*b* and 40*c* in accordance with the three-pole construction is provided to enclose the magnetic roller 15', and coils 41 and 42 are wound on the soft iron member so that poles $S_1$, $S_2$ and N are formed with the magnetic roller being in opposed relationship with the salient poles 40*a*, 40*b* and 40*c*, respectively. These coils 41 and 42 are connected through a switch 43 to a power source 44. The magnetic roller 15' may suitably be formed of ferrite or like material.

The positions of magnetization of the roller 15' may be varied by changing the positions of the salient poles 40*a*, 40*b* and 40*c*, and the number of the magentized poles may be increased by increasing the number of the salient poles. Also, magnetized poles having different field distributions may be provided by varying the width of the salient poles.

By the magnetizing method described just above, it is possible to provide not only the magnetic roller having the pole arrangement shown in FIGS. 6–8 but also the five-pole magnetic roller shown in FIG. 3 A or rollers with any other desired pole arrangements.

The developing device of the present invention, as has been described with reference to FIGS. 2 to 10, can accomplish quite ideal development which enjoys not only the excellence of tone image as achieved by the conventional magnetic brush method, but also the excellence of character reproducibility attributable to the cascade-like and powder-cloud-like effect occurring in the repelling magnetic fields.

What is claimed is:

1. A device for developing latent images comprising:

means for supporting a surface having a latent image to be developed;

a container for containing developer therein;

magnetic means supported in said container for producing magnetic fields, said magnetic means having adjacent magnetic poles of identical polarity disposed at a developing position opposed to said surface to be developed, wherein said adjacent poles are vertically spaced; and a non-magnetic member interposed between said surface to be developed and said magnetic field producing means, said non-magnetic member being movable relative to said magnetic field producing means to convey the developer, attracted thereto by said magnetic fields, from said container to said developing position in magnetic brush form of sufficient height at the developing position to contact said surface, wherein said adjacent poles of identical polarity produce a field therebetween which repels the conveyed developer from the surface of the non-magnetic member at the developing position, and wherein said non-magnetic developer conveying member is disposed to move downwardly at said developing position so that the force of gravity aids the repelling force of the magnetic field between said identical poles to project the developer onto said surface.

2. A device according to claim 1, wherein said magnetic field producing means includes a permanent magnet having said two magnetic poles of identical polarity at positions opposed to said surface to be developed.

3. A device according to claim 1, wherein said magnetic field producing means includes fixed magnet means magnetized so as to form said repelling magnetic fields at said developing position.

4. A device according to claim 1, further comprising means for moving said image supporting surface and said non-magnetic member in the same direction at said developing position.

5. A device according to claim 1, wherein said magentic means has a single pole different in position and polarity from said adjacent poles.

6. A device for developing electrostatic latent images comprising:

means for movably supporting a surface having a latent image to be developed;

a container for containing developer therein;

means for supplying developer into said container;

a magnetic member fixedly supported in said container for producing magnetic fields, said member having adjacent magnetic poles formed therewithin of identical polarity, said adjacent poles being disposed at a developing position opposed to said surface to be developed;

a non-magnetic rotatable member surrounding said magnetic field producing member for rotation to convey developer, attracted thereto by said magnetic fields, from said container to said developing position;

said magnetic poles of identical polarity being effective to form repelling magnetic fields therebetween at the position opposed to said surface to be developed and to form magnetic brushes of the developer in a repelling relationship with each other, said magnetic brushes being of sufficient height to contact said surface and said developer conveying non-magnetic member being disposed to move downwardly at said developing position so that the force of gravity aids the repelling force of the magnetic field between said identical poles to project the developer onto said surface.

7. A device according to claim 6, further comprising developer control means provided in a predetermined spaced apart relationship with the surface of said non-magnetic rotatable member.

8. A device according to claim 6, further comprising developer recovering means disposed in opposed relationship with a position downstream of said developing position, said recovery means including a second non-magnetic member having magnetic field producing means inside thereof for recovering the developer.

9. A device according to claim 6, further comprising developer control means spaced from the surface of said nonmagnetic member for controlling the thickness of the developer on said non-magnetic member.

10. A device according to claim 6, further comprising:

developer recovering means for removing excess developer from said surface positioned downstream of said developing position including a second non-magnetic member having magnetic field producing means inside thereof for recovering the excess developer, said developer recovering means further including means for collecting the developer from said second non-magnetic member and transporting the thus removed and collected developer to said container.

11. A device according to claim 6, further comprising:

developer recovering means positioned downstream of said developing position for recovering excess developer from said surface, said recovery means including a second nonmagnetic member having magnetic field producing means inside thereof and means for moving said non-magnetic member and said magnetic field producing member relative to said surface to be developed; and means for mixing and stirring the developer recovered by said developer recovering means with replenishment developer from said developer supply means.

12. An apparatus for developing electrostatically charged latent images on an image support member comprising:

a housing member adapted for storing a quantity of magnetically attractable developer material comprising magnetic carrier particles and triboelectrically charged toner particles;

a cylindrical applicator member of non-magnetic material rotatably mounted in said housing member for transporting a quantity of developer material from said housing member into developing relation with the image support member having latent electrostatic images thereon;

magnetic means enclosed in said applicator member for attracting the developer material from said housing member onto said applicator member so that said developer is in magnetic brush form of sufficient height at a developing position to contact said image support, said magnetic means having at least two identical magnetic poles adjacently spaced from each other at said developing position for generating therebetween at least two repelling magnetic lines of force extending in axial direction relative to said applicator member, wherein said non-magnetic applicator member is disposed to move downwardly at said developing position so that the force of gravity aids the repelling force of the magnetic field between said identical poles to project the developer onto said image support; and means for advancing said image support member having electrically charged latent images thereon over said applicator member.

13. In an apparatus for developing a latent image on an image bearing member, comprising driving means for moving said image bearing member to pass a developing station, a container for a developer mix including electroscopic developer powder particles and magnetic particles, a magnetic field producing means supported in said container, a cylindrical applicator of non-magnetic material enclosing said magnetic field producing means and movable relative thereto to convey the developer mix to the developing station so that the developer mix is in magnetic brush form of sufficient height at the developing position to contact said image bearing member, the improvement comprising:

a first magnetic pole disposed in said magnetic field producing means at a position corresponding to the image developing station of the apparatus;

a second magnetic pole having the same polarity as said first magnetic pole and adjacently spaced apart from said first magnetic pole, said first and second magnetic poles being cooperable with each other to produce a pair of repelling magnetic lines of force therebetween, wherein said non-magnetic applying member is disposed to move downwardly at said developing station so that the force of gravity aids the repelling force of the magnetic field between said poles to project the developer mix onto said image bearing member.

* * * * *